US007237967B2

(12) United States Patent
Nakamura et al.

(10) Patent No.: US 7,237,967 B2
(45) Date of Patent: Jul. 3, 2007

(54) DEVELOPING APPARATUS AND METHOD

(75) Inventors: Akihiko Nakamura, Kanagawa (JP); Yoshihiro Inao, Kanagawa (JP)

(73) Assignee: Tokyo Ohka Kogyo Co., Ltd., Kanagawa (JP)

( * ) Notice: Subject to any disclaimer, the term of this patent is extended or adjusted under 35 U.S.C. 154(b) by 57 days.

(21) Appl. No.: 10/997,816

(22) Filed: Nov. 24, 2004

(65) Prior Publication Data

US 2005/0180744 A1 Aug. 18, 2005

(30) Foreign Application Priority Data

Dec. 1, 2003 (JP) ..... 2003-402223

(51) Int. Cl.
*G03D 5/00* (2006.01)

(52) U.S. Cl. ..... 396/611; 396/604

(58) Field of Classification Search ..... 396/604, 396/611, 627; 355/27

See application file for complete search history.

(56) References Cited

U.S. PATENT DOCUMENTS 5,965,200 A * 10/1999 Tateyama et al. ..... 427/240
6,800,409 B2 * 10/2004 Huang ..... 430/30
6,991,385 B2 * 1/2006 Yoshihara et al. ..... 396/611

FOREIGN PATENT DOCUMENTS

JP 08-045832 2/1996
JP 10-012540 1/1998

* cited by examiner

*Primary Examiner*—D. Rutledge
(74) *Attorney, Agent, or Firm*—Carrier, Blackman & Associates, P.C.; Joseph P. Carrier; William D. Blackman

(57) ABSTRACT

A developing apparatus and method is provided in which the use amount of a developing solution can be reduced without deteriorating the accuracy of development. The developing apparatus comprises a new solution tank for storing an unused developing solution and a used solution tank for storing a used developing solution which is withdrawn from a material to be treated. A new solution feeding nozzle extends from the new solution tank, and the tip end of the nozzle faces toward the upper portion of the cup of each developing unit. A used solution feeding nozzle extends from the used solution tank, and the tip end of the nozzle faces toward the upper portion of the cup of each developing unit.

9 Claims, 3 Drawing Sheets

DEVELOPING APPARATUS AND METHOD

BACKGROUND OF THE INVENTION

1. Field of the Invention

The present invention relates to a puddle type developing apparatus, and a developing method using the apparatus.

2. Description of the Prior Art

In order to form a circuit on a surface of a substrate to be treated such as a semiconductor wafer, a photoresist is applied to the surface of the substrate, a circuit pattern is transferred to the photoresist by using photolithography technology, and a developing solution is supplied to a surface on which an undeveloped image pattern is formed, whereby a developed image pattern is formed on the surface of the substrate by developing the applied resist film.

There are several types of development such as a type in which a substrate to be treated is immersed in a developing solution, a type in which a developing solution is caused to flow as a shower on a surface of a substrate to be treated, or a puddle type in which a developing solution is applied over a photoresist on a surface of a substrate to be treated and the developing solution is thrown off by rotating the substrate to be treated after a lapse of a predetermined period of time. The types other than the puddle type have a drawback that a large amount of developing solution needs to be used.

Document 1 and Document 2 have disclosed a puddle type developing means. Document 1 has disclosed that a developing solution is applied over a surface of a substrate by using a slit nozzle, and thereafter the developing solution is withdrawn by using another nozzle so as to regenerate and reuse the withdrawn developing solution. Document 2 has disclosed that a developing solution is applied over a surface of a substrate, and thereafter the developing solution is withdrawn by covering the substrate with a case to which a sucking nozzle is connected, so as to regenerate and reuse the withdrawn developing solution.

[Document 1] Japanese Patent Application Publication No. 8-45832

[Document 2] Japanese Patent Application Publication No. 10-12540

In a common puddle type, a developing solution is replaced four to five times for conducting developing treatment to a single wafer. Development is conducted a plurality of times continuously. If a new solution is used for each development, a great volume of developing solution will be required. Therefore, by withdrawing and regenerating the used developing solution as disclosed in Documents 1 and 2, it is possible to make good use of the developing solution. However, in order to regenerate the used solution, it is necessary to conduct a regenerating treatment of the used solution by using a regenerating apparatus.

The present inventors have made this invention by paying attention to the fact that even a used solution has enough developing ability if the concentration of the solution is high.

SUMMARY OF THE INVENTION

According to the present invention, there is provided a puddle type developing apparatus in which a developing solution is applied onto a surface of a material to be treated, comprising a new solution tank for storing an unused developing solution, a used solution tank for storing a used developing solution which is withdrawn from the material to be treated, a cup, a chuck provided in the cup to rotate the material to treated, a new solution feeding nozzle which is connected to the new solution tank, a used solution feeding nozzle which is connected to the used solution tank, both nozzles being located above the cup, and a withdrawing pipe which connects the cup and the used solution tank, and branches into two branch pipes, the first branch pipe being connected to the used solution tank and the second branch pipe being connected to a waste section such as a waste tank.

With this structure, it is possible to reuse the used developing solution by circulating it within the developing apparatus without regenerating it.

The developing apparatus may have a structure in which a plurality of cups (developing unit) are provided in a multiple-stage state, and a developing solution is fed from the same new solution tank and the same used solution tank. With this, it is possible to make the size of the apparatus compact.

According to the present invention, there is also provided a developing method comprising the steps of removing a rinse liquid which is left in a cup and a pipe by using a used solution or an unused solution, and thereafter conducting a plurality of development processes continuously, wherein as for the intermediate development processes, a used solution withdrawn from a material to be treated is employed, or a used solution and an unused solution are employed alternately. An unused solution is employed for the first development process and the last development process.

DETAILED DESCRIPTION OF THE PREFERRED EMBODIMENTS

Figure 1:
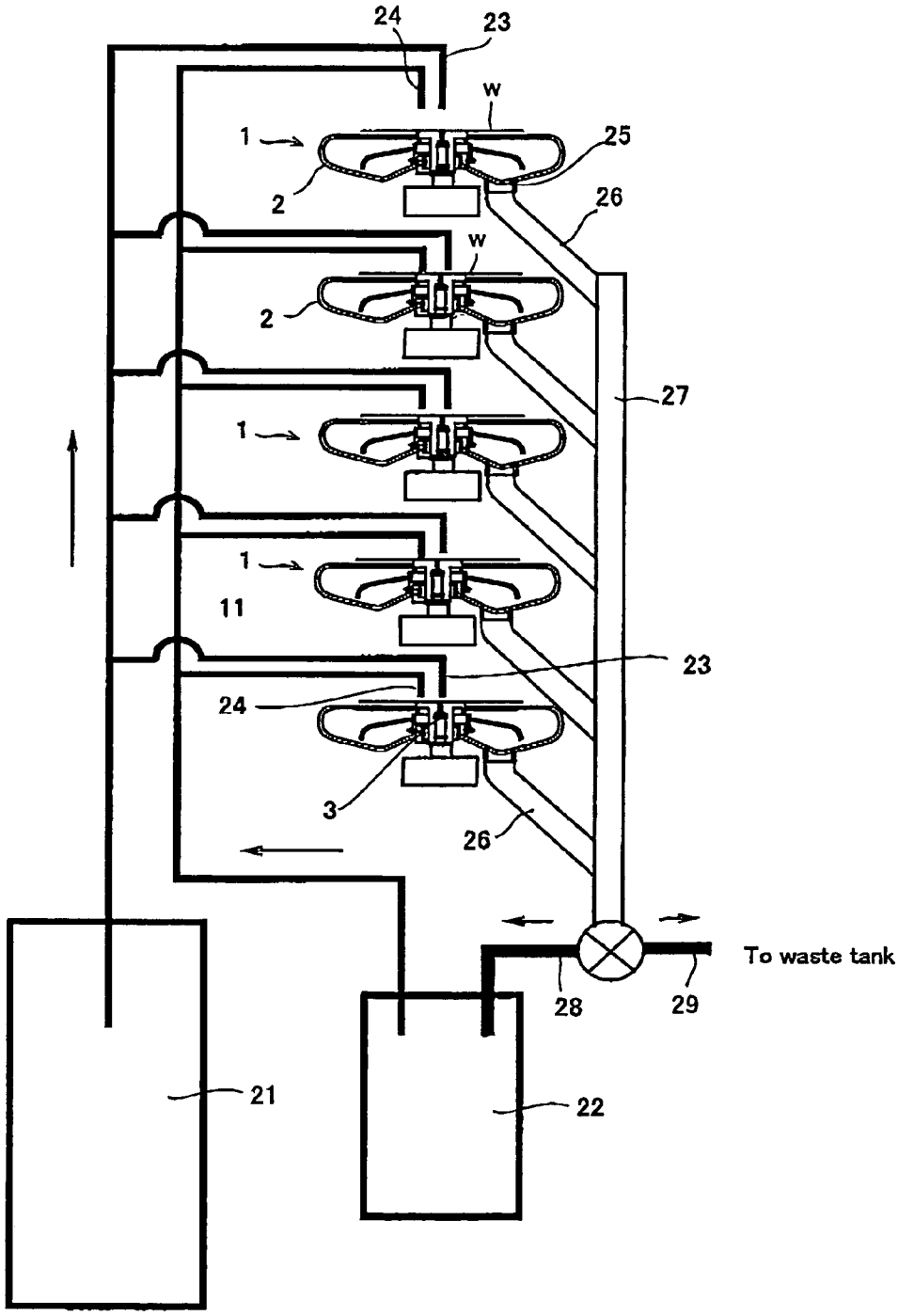
FIG. 1 shows the whole structure of a developing apparatus according to the present invention.
Figure 2:
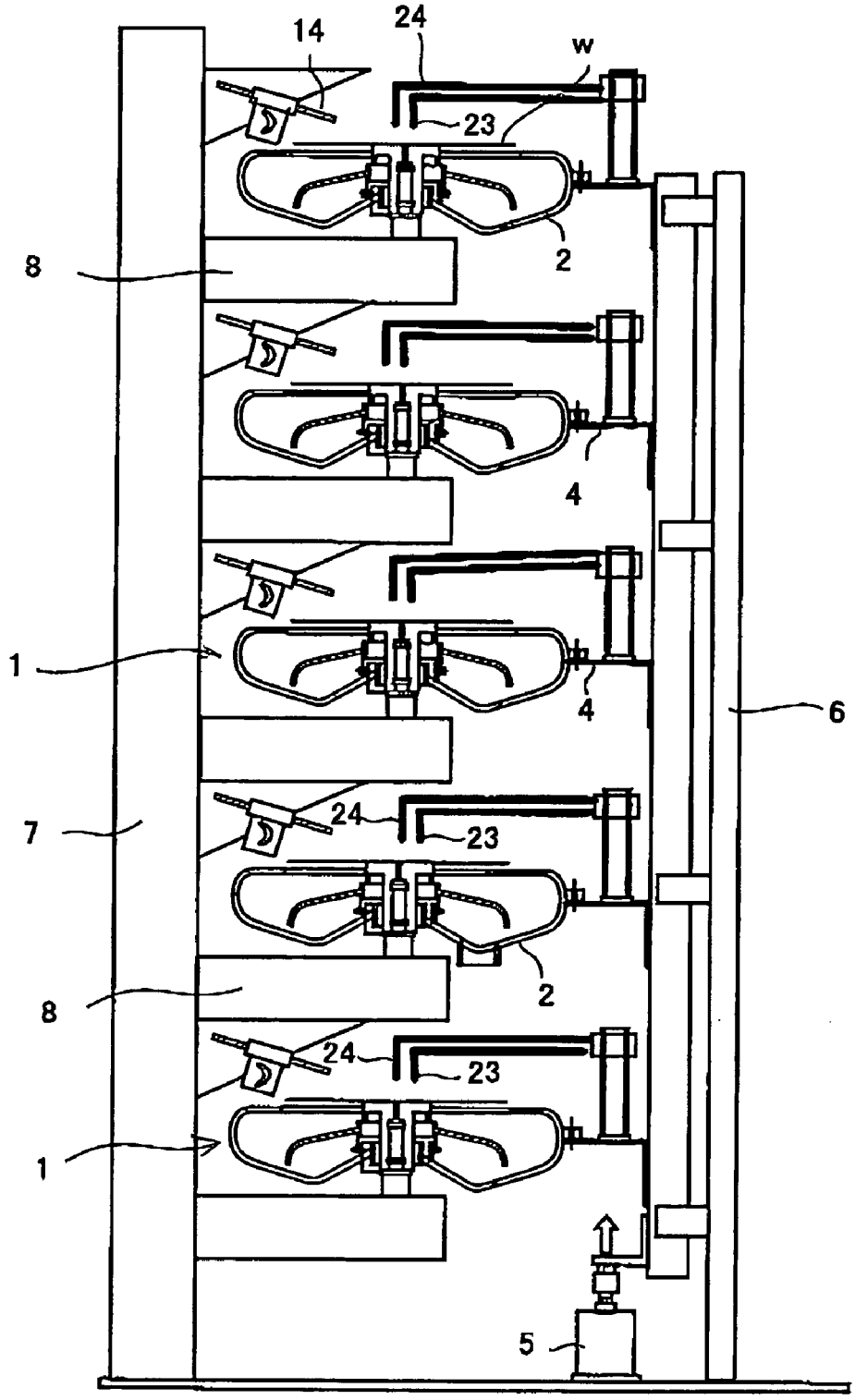
FIG. 2 shows the whole structure of the same developing apparatus seen from a different direction.
Figure 3:
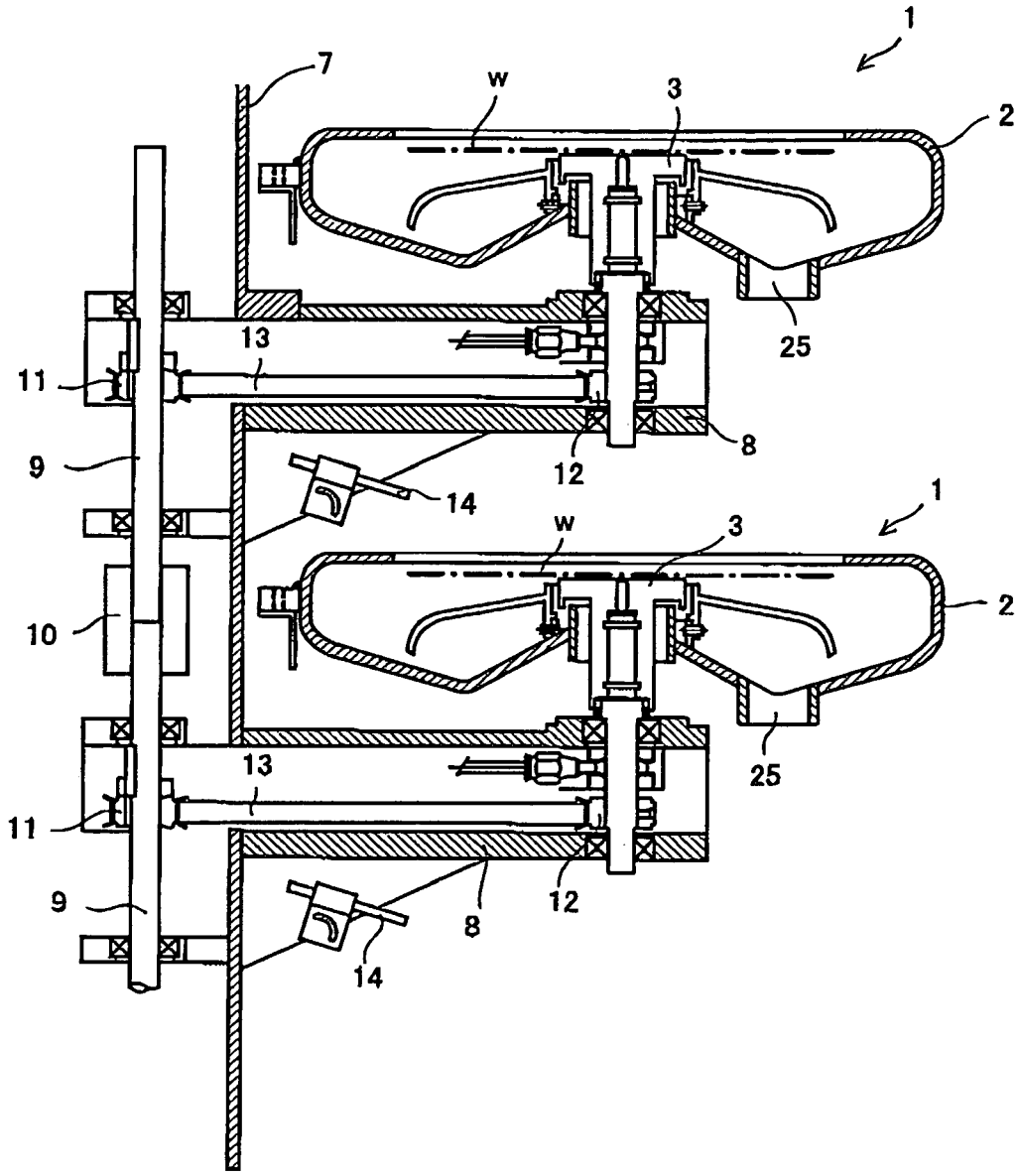
FIG. 3 is an enlarged cross-sectional view showing the structure of a developing unit.

Embodiments of the present invention will be described below with reference to the attached drawings. FIG. 1 shows the whole structure of a developing apparatus according to the present invention, FIG. 2 shows the whole structure of the same developing apparatus seen from a different direction, and FIG. 3 is an enlarged cross-sectional view showing the structure of a developing unit.

The developing apparatus is comprised of developing units 1 stacked in a multi-stage state in a vertical direction. Each developing unit 1 has a cup 2 surrounding a substrate and a chuck 3 for retaining and rotating a substrate, and the cup 2 can be elevated and lowered with respect to the chuck 3. Each cup 2 is supported by an arm 4, and the arms 4 are attached to a supporting post 6 in a horizontal direction at the same interval. The supporting post 6 is elevated and lowered by a cylinder unit 5.

A hollow supporting post 7 is disposed in a vertical direction, and hollow arms 8 are attached to the hollow supporting post 7, each hollow arm 8 extending toward each developing unit 1. A drive shaft 9 is disposed in a vertical direction within the hollow supporting post 7, the drive shaft being driven by a motor which is not shown in the drawing. The drive shaft 9 is divided corresponding to each developing unit 1, and each of the divided shafts 9 is jointed by a universal joint 10 with respect to each other. A drive pulley 11 is fixed to each drive shaft 9, and a driven pulley 12 is fixed to the axis of the chuck 3. A timing belt 13 is provided between the drive pulley 11 and the driven pulley 12 and accommodated in the horizontal arm 8. A rinse liquid feeding nozzle 14 is attached below the horizontal arm 8.

The developing apparatus is comprised of developing units 1 stacked in a multi-stage state in a vertical direction. Each developing unit 1 has a cup 2 surrounding a substrate W and a chuck 3 for retaining and rotating a substrate W, and the cup 2 can be elevated and lowered with respect to the chuck 3. Each cup 2 is supported by an arm 4, and the arms 4 are attached to a supporting post 6 in a horizontal direction at the same interval. The supporting post 6 is elevated and lowered by a cylinder unit 5.

In the embodiment shown in the drawing, each of the new solution feeding nozzles 23 and each of the used solution feeding nozzles 24 branch from a single pipe, respectively. However, each new solution feeding nozzle 23 and each used solution feeding nozzle 24 may individually extend from the new solution tank 21 and the used solution tank 22, respectively.

A drain hole 25 opens to the bottom surface of the cup 2, and a withdrawing pipe 26 is connected to the drain hole 25. The withdrawing pipes 26 are joined into a single vertical pipe 27, and the vertical pipe 27 branches into two branch pipes 28 and 29 at the bottom of the vertical pipe 27 by a valve. The branch pipe 28 is connected to the used solution tank 22, and the branch pipe 29 is connected to a waste tank or the like.

In operation, a developing solution is applied over a substrate W in a state where the substrate W is accommodated in the cup 2 by elevating the cup 2. After a predetermined period of time passes so that development is completed, the chuck 3 is rotated so as to allow the developing solution to be withdrawn. Normally, this process is repeated a plurality of times to complete development for a single substrate. Next, examples of the development process for a substrate W will be described.

Four Step Development Process (Preliminary Cleaning)

A rinse liquid left in the cup 2 and the pipe 26, 27 is removed by rinsing the cup 2 and pipe 26, 27 employing a used developing solution.

(First Development Process)

An unused developing solution is employed. This is because the first development process severely deteriorates a developing solution. All the solution used in this process is discarded.

(Second Development Process)

A used developing solution is employed. Since the concentration of the developing solution is deteriorated after the second development process, all the solution used in this process is discarded.

(Third Development Process)

An unused developing solution is employed. Since the concentration of the developing solution is not so much deteriorated after the third development process, the solution used in this process is withdrawn into the used solution tank 22 so as to be reused.

(Fourth Development Process)

An unused developing solution is employed. Since the concentration of the developing solution is not so much deteriorated after the fourth development process, the solution used in this process is withdrawn into the used solution tank 22 so as to be reused.

Five Step Development Process

The preliminary cleaning, the first, the second, and the third processes are the same as mentioned above.

(Fourth Development Process)

A used developing solution is employed. Since the concentration of the developing solution is deteriorated after the fourth process, all the solution used in this process is discarded.

(Fifth Development Process)

An unused developing solution is employed. Since the concentration of the developing solution is not so much deteriorated after the fifth development process, the solution used in this process is withdrawn into the used solution tank 22 so as to be reused.

As mentioned above, an unused developing solution is employed in the first and the last processes, while an unused developing solution and a used developing solution are employed alternately in the intermediate processes. By doing so, the use amount of the used solution is 50% or less with respect to the total use amount.

In the embodiments, the unused developing solution employed in the intermediate processes is employed alone. Also, the concentration of the used developing solution stored in the used solution tank 22 is 90% or more in the intermediate processes, and the developing solution having a concentration of less than this is discarded. Incidentally, the concentration of the developing solution is measured by a conductivity meter.

Effect of the Invention

According to the present invention, a used developing solution still having enough developing ability is employed alone or in combination with an unused developing solution. Consequently, the use amount of a developing solution can be reduced while keeping uniformity, and preventing drawbacks such as decrease of the film or occurrence of scum.

What is claimed is:

1. A puddle type developing apparatus in which a developing solution is applied onto a surface of a material to be treated and the developing solution is removed after lapse of a predetermined period of time, comprising:

a new solution tank for storing an unused developing solution;

a used solution tank for storing a used developing solution which is withdrawn from the material to be treated;

a cup;

a chuck provided in the cup to rotate the material to be treated;

a new solution feeding nozzle which is connected to the new solution tank and a used solution feeding nozzle which is connected to the used solution tank, both nozzles being located above the cup; and a withdrawing pipe which connects the cup and the used solution tank and branches into two branch pipes, the first branch pipe being connected to the used solution tank and the second branch pipe being connected to a waste section.

2. The developing apparatus according to claim 1, wherein a plurality of cups are provided in a multiple-stage state, and the new solution feeding nozzle and the used solution feeding nozzle are located above each cup, all the new solution feeding nozzles being connected to the same new solution tank and all the used solution feeding nozzles being connected to the same used solution tank.

3. The developing apparatus according to claim 1, wherein the developing apparatus further comprises a rinse liquid feeding nozzle.

4. The developing apparatus according to claim 1, wherein both the new solution feeding nozzle and the used solution feeding nozzle are supported on a first arm, and wherein the developing apparatus further comprises a rinse liquid feeding nozzle, and the rinse liquid feeding nozzle is supported on a second arm.

5. A developing method in which a developing solution is applied onto a surface of a material to be treated and the developing solution is removed after lapse of a predetermined period of time comprising the steps of:

removing a rinse liquid which is left in a cup and a pipe by rinsing the cup and pipe using a used developing solution or an unused developing solution, and thereafter conducting a plurality of development processes continuously, wherein the used developing solution and the unused developing solution are employed.

6. The developing method according to claim 5, wherein the unused developing solution is employed for the a first development process and a last development process among the plurality of development processes.

7. The developing method according to claim 5, wherein the used developing solution employed for the development process comprises developing solution removed from the surface of the material.

8. The developing method according to claim 5, wherein the used developing solution and the unused developing solution are employed in an alternating manner.

9. The developing method according to claim 5, wherein the method step of conducting a plurality of development processes continuously comprises a first application of solution in which the unused developing solution is employed, a second application of solution in which the used developing solution is employed, a third application of solution in which the unused developing solution is employed, a fourth application of solution in which the used developing solution is employed, and a fifth application of solution in which the unused developing solution is employed.

* * * * *

UNITED STATES PATENT AND TRADEMARK OFFICE

CERTIFICATE OF CORRECTION

PATENT NO. : 7,237,967 B2
APPLICATION NO. : 10/997816
DATED : July 3, 2007
INVENTOR(S) : Nakamura et al.

It is certified that error appears in the above-identified patent and that said Letters Patent is hereby corrected as shown below:

Column 1:
Line 6, Lines 27-28, and Line 61, change "puddle type" to --puddle-type--.
Line 67, change "material to treated" to --material to be treated--.

Column 2:
Line 49, change "surrounding a substrate" to --surrounding a substrate W--.
Line 50, change "rotating a substrate," to --rotating a substrate W,--.

Column 3:
Replace Lines 3-11 with:
--The developing apparatus further comprises a new solution tank 21 for storing an unused developing solution and a used solution tank 22 for storing a used developing solution which is withdrawn from a material to be treated. A new solution feeding nozzle 23 extends from the new solution tank 21, and the tip end of the nozzle 23 faces toward the upper portion of the cup 2 of each developing unit 1. A used solution feeding nozzle 24 extends from the used solution tank 22, and the tip end of the nozzle 24 faces toward the upper portion of the cup 2 of each developing unit 1. Both the nozzle 23 and the nozzle 24 are supported by the arm 4.--

Column 4:
Line 40, change "A puddle type" to --A puddle-type--.
Line 43, change "time, comprising:" to --time, the developing apparatus comprising:--.

UNITED STATES PATENT AND TRADEMARK OFFICE

CERTIFICATE OF CORRECTION

PATENT NO. : 7,237,967 B2
APPLICATION NO. : 10/997816
DATED : July 3, 2007
INVENTOR(S) : Nakamura et al.

It is certified that error appears in the above-identified patent and that said Letters Patent is hereby corrected as shown below:

Column 5:
Line 14, change "of time comprising" to --of time, said method comprising--.
Line 23, change "for the a first" to --for a first--.

Signed and Sealed this

Seventh Day of April, 2009

JOHN DOLL
*Acting Director of the United States Patent and Trademark Office*